US005424820A

United States Patent [19]

Bares et al.

[11] Patent Number: 5,424,820

[45] Date of Patent: Jun. 13, 1995

[54] CLEANER SUMP WITH MAGNETIC TRANSPORT

[75] Inventors: Jan Bares, Webster; Nero R. Lindblad, Ontario, both of N.Y.

[73] Assignee: Xerox Corporation, Stamford, Conn.

[21] Appl. No.: 112,924

[22] Filed: Aug. 30, 1993

[51] Int. Cl.[6] ..... G03G 21/00

[52] U.S. Cl. ..... 355/298; 355/299; 15/256.51

[58] Field of Search ..... 355/298, 253, 296, 299, 355/245; 118/652; 15/256.5, 256.51, 256.52, 256.53

[56] References Cited

U.S. PATENT DOCUMENTS

| | | | |
|---|---|---|---|
| 3,950,092 | 4/1976 | Zoltner . | |
| 4,140,389 | 2/1979 | Franke et al. | 118/652 X |
| 4,251,155 | 2/1981 | Schnall et al. . | |
| 4,436,414 | 3/1984 | Kamiyama . | |
| 4,496,240 | 1/1985 | Yamashita et al. . | |
| 4,671,207 | 6/1987 | Hilbert | 118/657 |
| 4,711,561 | 12/1987 | Tsuruoka . | |
| 4,730,205 | 3/1988 | Ogiri et al. . | |
| 4,768,062 | 8/1988 | Tanzawa et al. . | |
| 4,860,056 | 8/1989 | Kano et al. | 355/298 |
| 4,870,449 | 9/1989 | Brown | 355/298 X |
| 5,031,001 | 7/1991 | Kusumoto | 355/298 |
| 5,080,038 | 1/1992 | Rubin | 118/657 |
| 5,111,247 | 5/1992 | Nichols | 355/246 |
| 5,138,394 | 8/1992 | Watanabe et al. | 355/298 |
| 5,229,826 | 7/1993 | Sonnenberg | 355/298 |

*Primary Examiner*—R. L. Moses
*Attorney, Agent, or Firm*—T. L. Fair

[57] ABSTRACT

A cleaning system for increasing the packing density of a cleaner sump that uses magnetic toner, by filling unused sump space. The cleaning system uses a magnetic force to attract the magnetic waste toner to the sump area not filled by gravity assistance alone. The magnetic force is created by a magnet. The magnet can be either internal to the sump or external thereto.

16 Claims, 3 Drawing Sheets

CLEANER SUMP WITH MAGNETIC TRANSPORT

BACKGROUND OF THE INVENTION

This invention relates generally to electrophotographic printing, and more particularly, concerns increasing the capacity of the cleaner sump.

One of the constraints on the life of a Customer Replaceable Unit (CRU) is the capacity of the cleaner sump. This constraint is especially true for small copiers or printers which must avoid toner transportation devices that limit the sump capacity to that of the volume that can be reached by gravity assisted flow alone. Once all the gravity assisted flow assessable volume is filled, the pressure on the cleaning blade and on the sealing Mylar flap (i.e. the flap prevents waste toner from leaking from the sump) starts building up resulting in a cleaner failure. The cleaner failure is either a toner spill through a lower seal or failure to clean adequately. The CRU life can be extended by utilizing more of the available sump capacity that is not filled by gravity assisted flow alone, to prolong the cleaner failures occurring due to pressure on the cleaning blade and flap.

The following disclosures may be relevant to various aspects of the present invention and may be briefly summarized as follows:

U.S. Pat. No. A-4,547,063 to Stange discloses a moving magnet cleaner for scraping excess toner off of a photoreceptor surface. The moving magnet cleaner provides carrier bristles for brushing the photoreceptor surface. The sweeping of the moving magnet cleaner past the photoreceptor provides a self-leveling of the carrier bristles to the size of the distance between the cleaner roll and the photoreceptor surface. A toner roll rotates in proximity to the cleaner roll to transfer toner from the carrier particles to the toner roll and also provides self-leveling of the carrier bristles. The carrier for the magnet cleaner is continually replaced with carrier from a sump and the moving magnet cleaner exhibits a large cleaning zone allowing for gentle removal of the toner from the photoreceptor.

U.S. Pat. No. A-4,671,207 to Hilbert discloses a magnetic brush development apparatus for applying developer material to a latent image on a photoconductor which includes a housing having a sump which receives a supply of developer material. A magnetic brush spaced from the sump applies the material to the latent image of a photoconductor as a photoconductor is moved past a magnetic brush. A feed mechanism delivers developer material from the sump through a slot to the magnetic brush. The feed mechanism includes a rotatable shell and a plurality of magnets that are located within the shell and attract developer material to a portion of the shell. The shell has a deeply fluted outer surface that holds the developer material attracted to the shell as it is delivered from the sump to the slot.

U.S. Pat. No. A-5,080,038 to Rubin discloses a development apparatus for developing latent images on an image-bearing surface which includes a magnetic core generating a first magnetic field, a non-magnetic shell, surrounding and spaced from the magnetic core, and a transport assist magnet mounted at a desired spot between the non-magnetic shell and the magnetic core. The transport assist magnet generates a second magnetic field at and about the desired spot thereby creating a magnetic field strength gradient thereabout for assisting the magnetic transportation of magnetic developer material over the surface of the non-magnetic sheet.

U.S. Pat. No. A-5,111,247 to Nichols discloses a toner concentration sensing system for controlling the dispensing of toner into a developer sump. A toner concentration sensor is located in the bottom of the mixing area of the developer sump adjacent one of the mixing augers. A magnet is positioned on the rotating mixing auger for rotating with the auger past the toner concentration sensor. As the auger rotates, the magnet with developer material adhering thereto, sweeps the top of the toner sensor to improve the accuracy of the toner concentration readings.

SUMMARY OF INVENTION

Briefly stated, and in accordance with one aspect of the present invention, there is provided an apparatus for cleaning a surface, comprising a housing defining a chamber for storing material removed from the surface, and a packing member for packing the material stored in the chamber of the housing.

Pursuant to another aspect of the present invention, there is provided an operator replaceable unit adapted to be used in a printing machine of the type having material to be removed from a surface, comprising a housing defining a chamber for storing material removed from the surface, and a packing member for packing the material stored in the chamber of the housing.

BRIEF DESCRIPTION OF THE DRAWINGS

Other features of the present invention will become apparent as the following description proceeds and upon reference to the drawings, in which.

DETAILED DESCRIPTION OF THE INVENTION

Reference is now made to the drawings where the showings are for the purpose of illustrating a preferred embodiment of the invention and not for limiting same.

Figure 1:
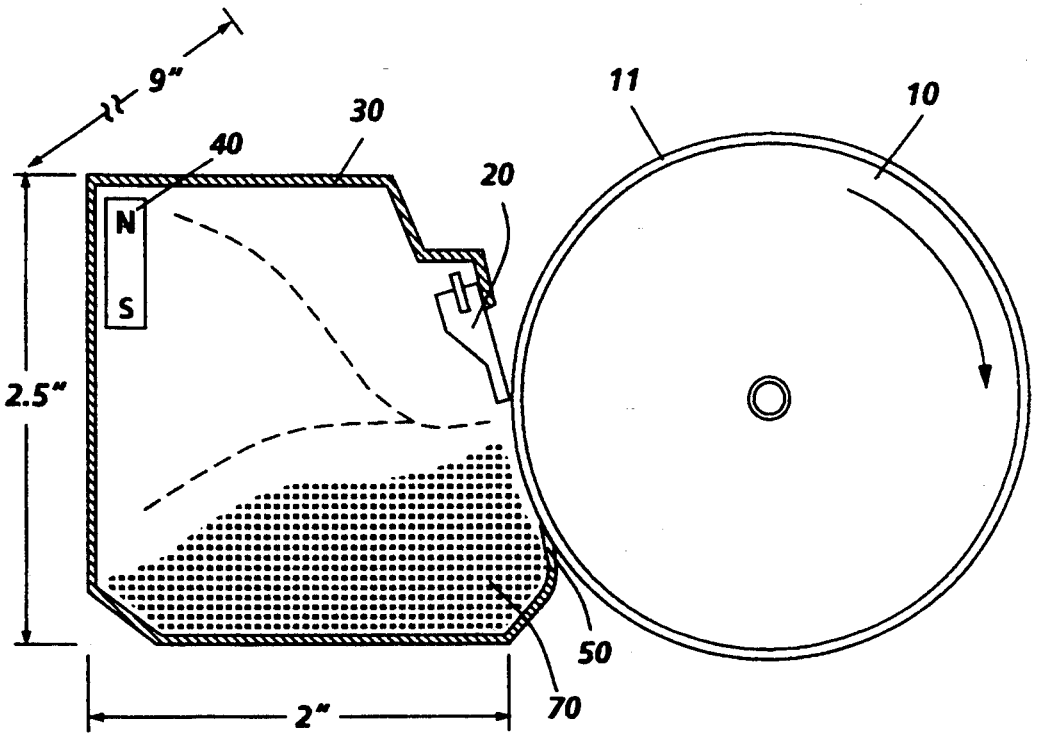
FIG. 1 is an elevational view of the cleaner sump with a stationary magnet contained therein.

Referring now to FIG. 1, which is an elevational diagram of the cleaner sump 30 adjacent to the photoreceptor drum 10. A cleaning blade 20 contacts the imaging surface 11 of the photoreceptor drum 10. Behind the cleaning blade 20 is a waste toner sump 30. A system that relies only upon gravity assisted fill for the sump (i.e. no magnet), would not fill in the upper most portion of the cleaner sump 30 thus, causing inefficient use of the cleaner sump 30 and a shorter CRU life.

A waste tone seal 50 presents toner from escaping the waste tone sump 30.

This inefficient use of the sump 30 can be shown by the following example. The maximum volume, V, (i.e. $V = \text{depth} \times \text{width} \times \text{height}$) of a sump that is about 2 in. deep, about 9 in. wide (i.e. width across photoreceptor), and about 2.5 in. high (as shown in FIG. 1 ) is about 45 $in^3$ (or about 737 $cm^3$). The maximum amount of toner that can then be packed in a sump with this volume (i.e. 45 in.$^3$), is the product of the volume, V, and the packing density, P, (where P=0.3 g/cm$^3$) is about 221 grams. Gravity assisted fill alone provides about a 60% sump fill. Since the amount of toner that can be packed into the sump 30 is about 221 grams, the 60% sump fill achieved by gravity is about 132 grams. The residual mass left on the photoreceptor drum 10 after transfer is about 0.015g/copy. Thus, 132 grams of residual mass would equal about an 8.8 kc [(i.e. (132g)/(0.015g/copy) (1 kc/1000 copies)]. If an Average Monthly Copy Volume (AMCV) is 1.5 kc for copier, the CRU life would be about 5.9 months [(i.e. 8.8 kc/(1.5 kc/month)]for a "short edge feed" A "short edge feed" is when 8½ in.×14 in. paper is fed into the copier by it's 8½ in. edge where the typical process width is 9 in. to avoid edge effects. A "long edge feed" is where the paper is fed in by it's 14 in. edge. Assuming a "long edge feed" and the width of the sump 30 is 15 in., the sump width and volume is increased by a factor of 15/9, thus, the CRU life for "long edge feed" is 9.8 months (i.e. 5.9 in.×15/9 in.).

With continued reference to FIG. 1, the present invention shows how the sump capacity can be increased when the system utilizes magnetic toner and magnet 40. The filling of the sump 30 is extended by placing the magnet 40 at a fixed position in the sump 30, in an area removed from the cleaning blade 20. The magnet 40 extends lengthwise from the inboard to outboard of the sump or cavity 30. The magnet 40 attracts toner, by magnetic force, up or further away from the cleaner blade 20 permitting more effective utilization of the sump space not utilized by gravity assisted filling alone.

A magnet 40 placed along a side of the waste toner sump 30, attracts the waste toner by magnetic force from the parts of the sump 30 being filled by gravity assisted flow. To maximize the mass held by the magnet 40, the magnet 40 is preferably mounted on the inside of the sump 30, for example, bonded to the wall of the sump housing (as shown in FIG. 1) or inserted between tabs (not shown) made in the sump molding process. Laboratory testing with magnetic toner has shown that a 9 in. stationary magnet 40 (e.g. plastic magnet extrusion) can hold approximately 28 grams of toner. A 15 in. magnet rather than a 9 in. magnet is used for a long edge feed. A 15 in. magnet holds approximately 47 grams of toner (i.e. 28 g×15in./9 in.=47 g).

Continuing with the above mentioned example, the addition of a 9 in. magnet in the sump 30, increases the sump capacity from 132 grams to 160 grams (i.e., 132 grams+28 grams). The residual mass left on the drum 10, after transfer, is about 0.015 g/copy. Thus, the 160 grams of toner in the sump represents about 10.7 kc. With an AMCV of about 1.5 kc for the copier, the CRU life would be approximately 7.1 months for the "short edge feed" paper and approximately 11.8 months for "long edge feed" paper. Thus, by adding a magnet 40 (or some other mechanical means) to move toner to the rear of the sump 30, the CRU life is increased by about 20% for both "short" and "long" edge feed over the CRU life of a sump without a means to move toner away from the cleaning blade. The magnetic attraction increases waste toner capacity permitting an additional 3000 copies to be made with the CRU unit.

Figure 2:
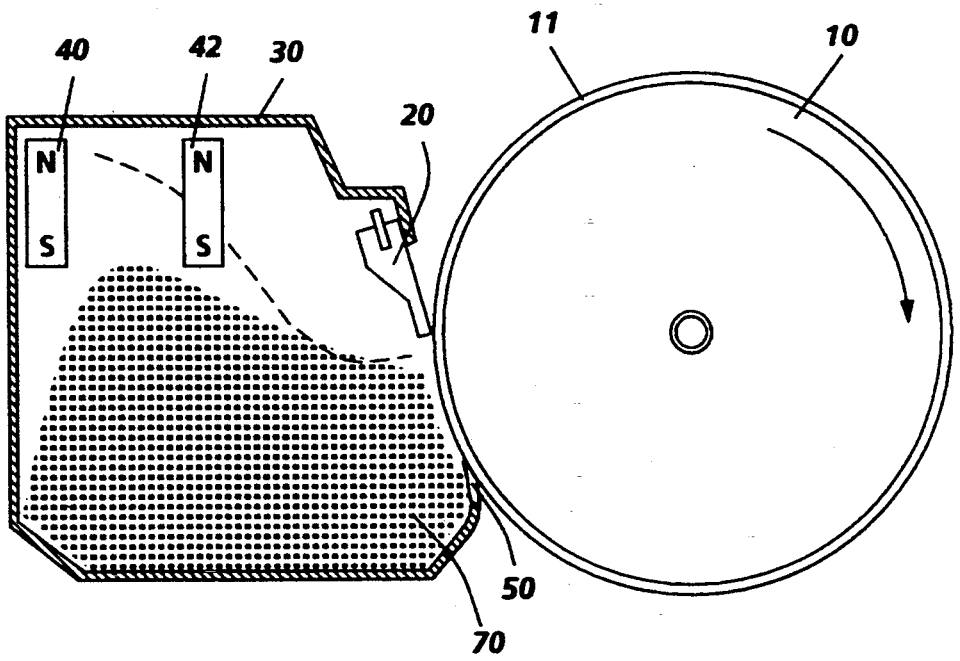
FIG. 2 is an elevational view of the cleaner sump with two stationary magnets contained therein.

Reference is now made to FIG. 2, that shows two stationary magnets 40, 42 in the cleaner toner sump 30. Two magnets 40, 42 (i.e. each about 9 in. in length) would increase the sump capacity by 56 grams (i.e. 2 grams×28 grams). Thus, increasing the sump capacity to 188 grams. The 188 grams of toner 70 in the sump 30 represents approximately 12.5 kc. The approximately 13.9 months for "long edge feed" which is an increase of about 41% over the CRU life of a sump without a means to move the toner to the rear of the sump.

Figure 3:
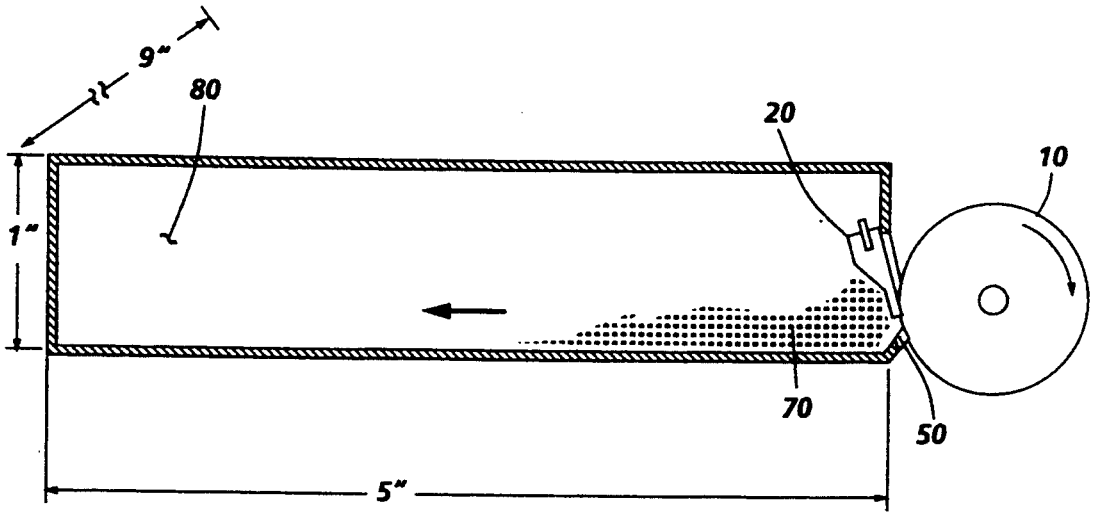
FIG. 3 is an elevational view of an alternate cleaner sump configuration without a magnet.

Reference is now made to FIG. 3 which shows another configuration of a cleaner sump 80. This type of sump 80 is best suited for small photoreceptor drums because of the height of the sump. Since the photoreceptor drum is small, the cleaner height must be very low to permit placing other subsystems around the photoreceptor perimeter. Continuing with the above mentioned example, the maximum amount of toner that can be packed into the sump 80 configured above is the same as that of FIG. 1, (i.e. 221 grams), because both FIG. 1 and FIG. 3 (V=9 in.×5 in. ×1 in.=45 in.$^3$ or 737 cm$^3$), coincidentally have equivalent volumes. Without the use of rotating magnets (or some other mechanical means), the sump 80 would be filled inefficiently to only about 40% (i.e. 190 grams) of it's volume. This inefficiency occurs because without a magnet there would be no means to move the toner into the rear of the sump 80. Thus, the CRU life, without a magnet or any mechanical means to move toner to the rear of the sump, for a "short edge feed" is 3.9 months and 6.5 months for a "long edge feed".

Figure 4:
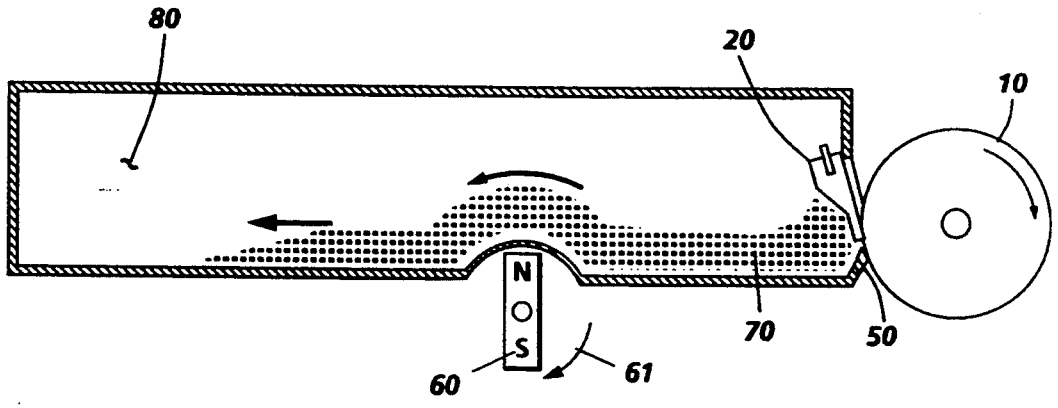
FIG. 4 is an elevational view of a horizontal transport cleaner sump with an external rotating magnet.

Reference is now made to FIG. 4, which shows an alternate embodiment of the present invention, using an external rotating magnet 60. In this embodiment, the magnet application can be readily extended to waste toner transporting devices matched to waste toner sumps of a specific shape. For example, externally moving magnets or rotating magnets 60 move toner 70 away from the cleaning blade 20. An advantage of an externally placed transport device is that it is not discarded with the cartridge. FIG. 4 shows an application for horizontal transport.

According to bench testing, the rotating magnet 60 exerts enough lateral force to move and pack the toner 70 away from the cleaning zone. The cleaning zone is where the blade cleaning edge contacts the photoreceptor. A laterally extended sump 80, as shown in FIG. 4, is becoming especially desirable with the introduction of smaller diameter photoreceptors. As the magnet 60 rotates in the clockwise direction 61 it moves the magnetic toner 70 to the left and further back into the sump 80. The continuous movement of toner 70 in the sump 80, packs the toner 70 in the rear of the sump 80.

With continuing reference to FIG. 4, the rotating magnet 60 enables up to 70% (or about 155 grams) of the sump to be filled. The 155 grams of the toner in the sump 80 represents about 10.3 kc. The CRU life for "short edge feed" is approximately 6.9 months and for "long edge feed" is approximately 11.5 months increasing the CRU life, for both "short" and "long" edge paper feed by approximately 77% over the CRU life of a sump without a rotating magnet.

Figure 5:
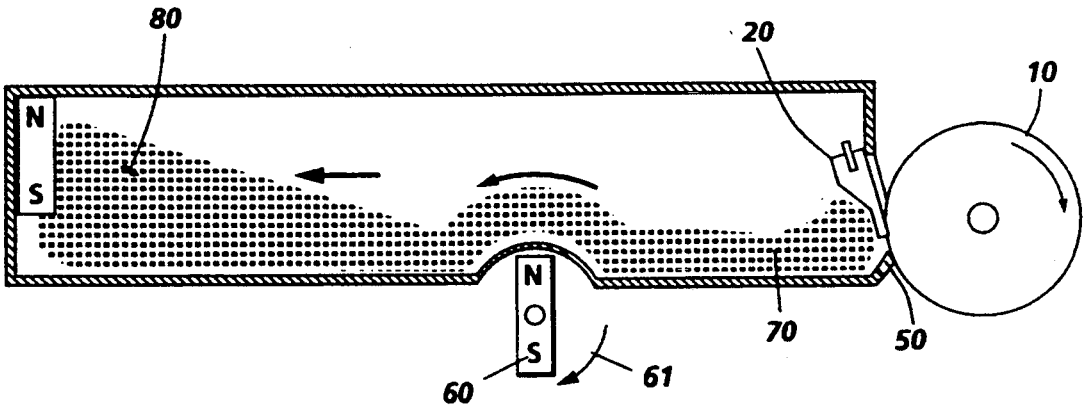
FIG. 5 is an elevational view of a horizontal transport cleaner sump with an internal stationary magnet and an external rotating magnet.

Another embodiment to further increase storage capacity and to more effectively fill the sump 80 is shown in FIG. 5. In addition to the rotating magnet 60, a 9 in. stationary magnet 40 is placed in the sump 80. As previously mentioned, the 9 in. long magnet can hold 28 grams of toner, thus, increasing the toner sump capacity in this configuration to about 83% or about 183 grams. The 183 grams of toner in the sump represents about 12.2 kc. The CRU life would be approximately 8.1 months for a "short edge combination of a fixed and rotating magnet for the sump increases the CRU life for both "short" and "long" edge paper feed by approximately 110% over the CRU life without a magnet.

The following Tables 1 and 2 summarize the experimental data on CRU life improvement for a sump volume of 45 in.$^3$ (737 cm$^3$) discussed above.

TABLE 1

Stationary magnet in a cleaner sump with a preferred geometry of 2 in. × 2.5 in. × 9 in. (or 15 in. in the case of long edge feed).

| No Magnets | Single Stationary Magnet | Two Stationary Magnets |
|---|---|---|
| Short edge feed CRU life = 5.9 months. | Short edge feed CRU life = 7.1 months. | Short edge feed CRU life = 8.3 months. |
| Long edge feed CRU life = 9.8 months. | Long edge feed CRU life = 11.8 months. | Long edge feed CRU life = 13.9 months. |

TABLE 2

Rotating magnets with a preferred sump geometry of 1 in. × 5 in. × 9 in. (or 15 in. in the case of long edge feed).

| No Magnets | Rotating Magnets | Fixed and Rotating Magnets |
|---|---|---|
| Short edge feed CRU life = 3.9 months. | Short edge feed CRU life = 6.9 months. | Short edge feed CRU life = 8.1 months. |
| Long edge feed CRU life = 6.5 months. | Long edge feed CRU life = 11.5 months. | Long edge feed CRU life = 13.6 months. |

Most low volume and small size copiers or printers utilize magnetic toner for regular documents and now also as desktop MICR (Magnetic Ink Character Recognition) printers. (An MICR printer prints checks and other magnetically readable documents.) In the case of small printers where CRU or cartridge life is important, increasing waste toner sump capacity by use of the present invention is highly desirable.

In recapitulation, it is evident that the cleaning apparatus of the present invention includes a magnet, that moves toner away from the cleaning blade, permitting more effective utilization of the cleaner sump space and prolonging cleaning failures. The present invention proposes to do this by utilizing an inexpensive magnet placed internally in the cleaner sump, or an externally mounted magnet or a combination thereof. Experimental data has shown that stationary magnets increase the (conventional) sump capacity over a sump with no magnets by about 20% to about 42%. A rotating magnet increases sump storing capacity of a flat sump over a sump with no magnets by about 77%. And, a rotating magnet plus a fixed magnet increases the (flat) CRU life by almost 110%. A summary of the improvement to CRU life by the present invention appears in chart form in Tables 1 and 2, above. With these above mentioned embodiments, there is little expense involved in increasing the capacity of the cleaner blade sump because the invention does not increase the cost of the cleaning apparatus, nor does it increase the size of the cleaner sump. Thus, the CRU life is improved through a reduced failure rate without a significant increase in the unit manufacturing cost (UMC).

It is, therefore, evident that there has been provided, in accordance with the present invention, an increased cleaner sump capacity. The cleaning apparatus of the present invention fully satisfies the objects, aims and advantages hereinbefore set forth. While this invention has been described in conjunction with the specific embodiment thereof, it is evident that many alternatives, modifications and variations will be apparent to those skilled in the art. Accordingly, it is intended to embrace all such alternatives, modifications and variations as fall within the spirit and broad scope of the appended claims.

It is claimed:

1. An apparatus for cleaning magnetic material from a surface, comprising:

a housing defining a chamber for storing magnetic material including magnetic particles removed from the surface;

a cleaning member, disposed at least partially in the chamber of said housing, for removing magnetic material from the surface, said cleaning member comprising a blade; and a magnet, located remotely from said blade, adapted to attract and move the magnetic material for packing the magnetic material stored in the chamber of said housing, said magnet is mounted in the chamber of said housing.

2. An apparatus as recited in claim 1, wherein said magnet attracts the particles from said blade.

3. An apparatus as recited in claim 2, further comprising a second magnet.

4. An apparatus as recited in claim 3, wherein said second magnet is mounted in the chamber of said housing.

5. An apparatus as recited in claim 4, wherein said second magnet is located remotely from said blade.

6. An apparatus for cleaning magnetic material from a surface, comprising:

a housing defining a chamber for storing magnetic material, including magnetic particles, removed from the surface;

a cleaning member, disposed at least partially in the chamber of said housing, for removing magnetic material from the surface, said cleaning member comprising a blade; and.

magnets, including a first magnet and a second magnet, adapted to attract and move the magnetic material for packing the magnetic material stored in the chamber of said housing, said first magnet, mounted rotatably, is located remotely from said blade to attract particles therefrom and located external to the chamber of said housing adjacent thereto.

7. An apparatus as recited in claim 6, wherein said second magnet is mounted in the chamber of said housing.

8. An apparatus as recited in claim 7, wherein said second magnet is located remotely from said blade.

9. An operator replaceable cleaning unit adapted to be used in a printing machine of the type having magnetic material to be removed from a surface, comprising:

a housing defining a chamber for storing magnetic material, including magnetic particles, removed from the surface;

a cleaning member, disposed at least partially in the chamber of said housing, for removing the magnetic material from the surface, said cleaning member comprises a blade; and a magnet, located remotely from said blade, adapted to attract and move the magnetic material for packing the magnetic material stored in the chamber of said housing, said magnet is mounted in the chamber of said housing.

10. A cleaning unit as recited in claim 9, wherein said magnet attracts the particles from said blade.

11. A cleaning unit as recited in claim 10, further comprising a second magnet.

12. A cleaning unit as recited in claim 11, wherein said second magnet is mounted in the chamber of said housing.

13. A cleaning unit as recited in claim 12, wherein said second magnet is located remotely from said blade.

14. An operator replaceable cleaning unit adapted to be used in a printing machine of the type having magnetic material to be removed from a surface, comprising:

a housing defining a chamber for storing magnetic material including magnetic particles removed from the surface;

a cleaning member, disposed at least partially in the chamber of said housing, for removing the magnetic material from the surface, said cleaning member comprises a blade; and magnets, including a first magnet and a second magnet, adapted to attract and move the magnetic material for packing the magnetic material stored in the chamber of said housing, said first magnet located remotely from said blade to attract particles therefrom and located external to the chamber of said housing adjacent thereto, said chamber of said housing includes a semicircular indentation adapted to have said first magnet mounted rotatably therein and spaced from said housing during rotation thereof, said first magnet rotates between a range of approximately 10 rpm to approximately 150 rpm.

15. A cleaning unit as recited in claim 14, wherein said second magnet is mounted in the chamber of said housing.

16. A cleaning unit recited in claim 15, wherein said second magnet is located remotely from said blade.

* * * * *